United States Patent [19]

Matsumoto

[11] Patent Number: 4,475,502

[45] Date of Patent: Oct. 9, 1984

[54] OVERHEAT PREVENTING SYSTEM FOR INTERNAL COMBUSTION ENGINES

[75] Inventor: Kuniyoshi Matsumoto, Hamamatsu, Japan

[73] Assignees: Yamaha Hatsudoki Kabushiki Kaisha, Iwata; Sanshin Kogyo Kabushiki Kaisha, Hamamatsu, both of Japan

[21] Appl. No.: 363,464

[22] Filed: Mar. 30, 1982

[30] Foreign Application Priority Data

Apr. 30, 1981 [JP] Japan ..... 56-65630

[51] Int. Cl.[3] ..... F02M 7/04

[52] U.S. Cl. ..... 123/331; 123/198 D; 261/39 R; 261/DIG. 74; 261/64 E

[58] Field of Search ..... 261/DIG. 74, 39 R; 123/331, 330, 198 D, 64 E

[56] References Cited

U.S. PATENT DOCUMENTS

| | | | |
|---|---|---|---|
| 1,499,708 | 7/1924 | Tuten | 123/198 D |
| 1,907,351 | 5/1933 | King et al. | 123/198 D |
| 2,988,069 | 6/1961 | Smith | 123/198 D |
| 3,794,004 | 2/1974 | Stoltman | 123/330 |

FOREIGN PATENT DOCUMENTS

| | | | |
|---|---|---|---|
| 2908643 | 9/1980 | Fed. Rep. of Germany | 261/DIG. 74 |
| 354859 | 8/1931 | United Kingdom | 261/64 E |

*Primary Examiner*—Tim R. Miles

*Attorney, Agent, or Firm*—Donald D. Mon; David O'Reilly

[57] ABSTRACT

An overheat preventing system for internal combustion engines, especially for outboard engines. The engine includes a choke valve, and electromagnetic means for closing the choke valve. A thermo-switch that is responsive to engine temperature is effective to cause the electromagnetic means to close the choke valve and reduce the engine speed when the engine temperature is too hot.

2 Claims, 5 Drawing Figures

OVERHEAT PREVENTING SYSTEM FOR INTERNAL COMBUSTION ENGINES

FIELD OF THE INVENTION

This invention relates to systems which prevent the overheating of an internal combustion engine, especially outboard engines.

BACKGROUND OF THE INVENTION

Because conventional outboard engines are not equipped with overheat preventing systems, there arises the risk that the engine may be continuously run, through ignorance of the fact that the engine is overheated, until it is damaged.

The present invention has been conceived to provide an engine overheat preventing system which detects overheating of the engine and then automatically prevents the engine from being overheated.

BRIEF DESCRIPTION OF THE INVENTION

According to the present invention, there is provided an engine overheat preventing system which is characterized in that electromagnetic actuating means connected to a choke valve is connected with an electric power source through a thermo-switch. When the engine temperature exceeds a predetermined level the thermoswitch actuates the electromagnetic means to close said choke valve. As a result, when the engine is overheated, the choke valve is closed to reduce the r.p.m. of the engine, thereby to automatically prevent the engine from being overheated.

In the preferred embodiment, a choke switch that can manually be closed is in parallel with the thermo-switch.

A preferred embodiment of an engine overheat preventing system according to the present invention will be described in detail in the following with reference to the accompanying drawings, in which:

DETAILED DESCRIPTION OF THE INVENTION

Figure 1:
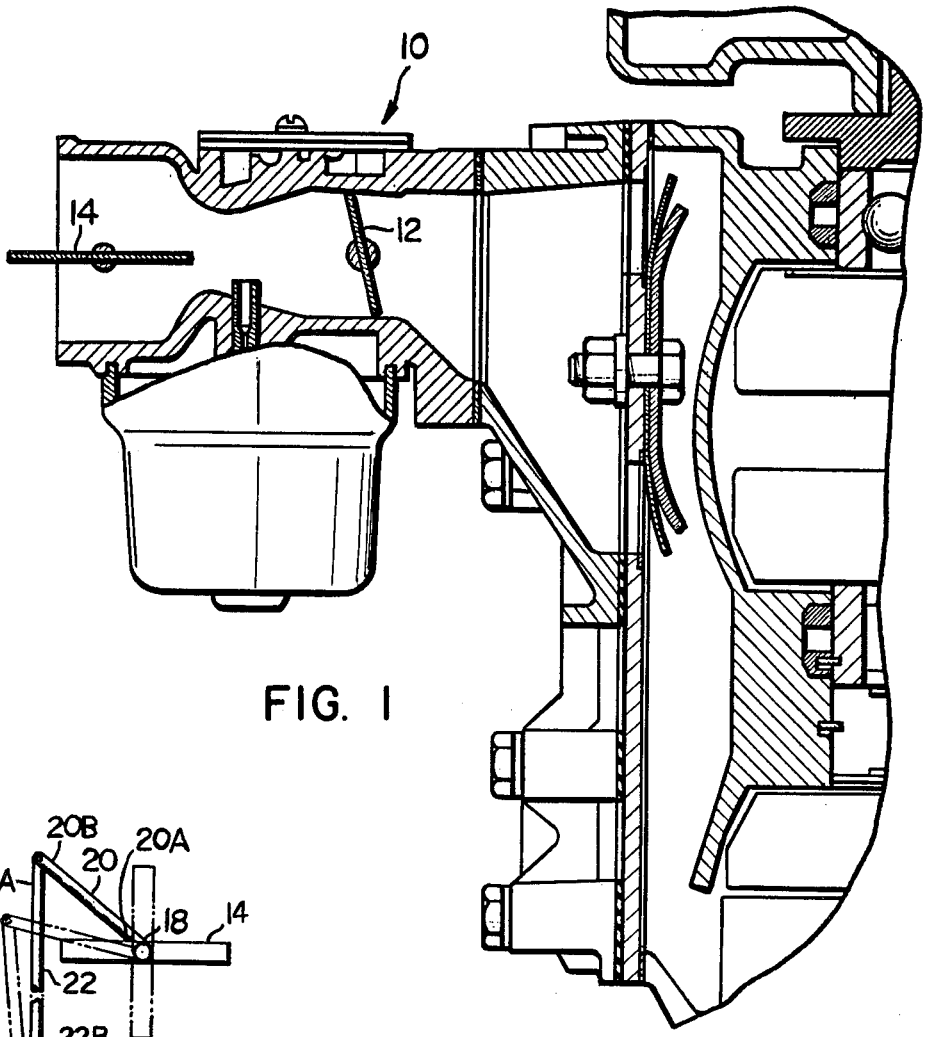
FIG. 1 is a sectional view showing the construction in the vicinity of the carburetor of an outboard engine, to which the embodiment according to the present invention is applied.
Figure 2:
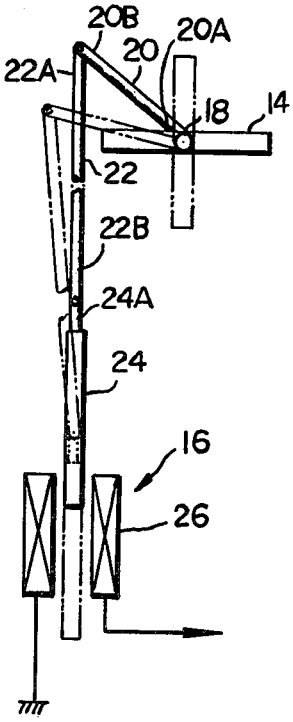
FIG. 2 is an explanatory view showing the schematic construction of the mechanism connecting the choke valve and the solenoid.

FIG. 1 shows the schematic construction in the vicinity of the carburetor of an outboard engine. In FIG. 1, a carburetor 10 is equipped with a throttle valve 12 and with a choke valve 14 which is disposed upstream of throttle valve 12. Choke valve 14 is connected, as shown in FIG. 2, to a solenoid 16 acting as electromagnetic means. To shaft 18 of choke valve 14, there is fixed one end 20A of a link 20, which has its outer end 20B hinged to one end 22A of a link 22. The other end 22B of link 22 is hinged to the end portion 24A of plunger 24 of solenoid 16.

The position of the choke valve, which is indicated by solid lines in FIG. 2, shows the open state of choke valve 14. When an electric current flows through the coil 26 of solenoid 16, plunger 24 is attracted downwardly by coil 26 so that choke valve 14 is accordingly turned to the position indicated by double-dotted lines in the same Figure, thereby to come into its closed state.

Figure 3:
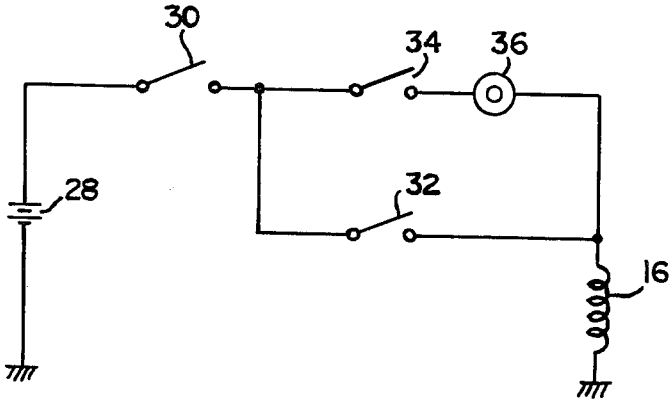
FIG. 3 is a circuit diagram showing the operations of the solenoid.

FIG. 3 shows the operating circuit of solenoid 16. As shown in FIG. 3, solenoid 16 is connected with an electric power source 28 through a main switch 30 and a choke switch 32. A thermo-switch 34 and a buzzer 36 are connected in parallel with choke switch 32.

Figure 4:
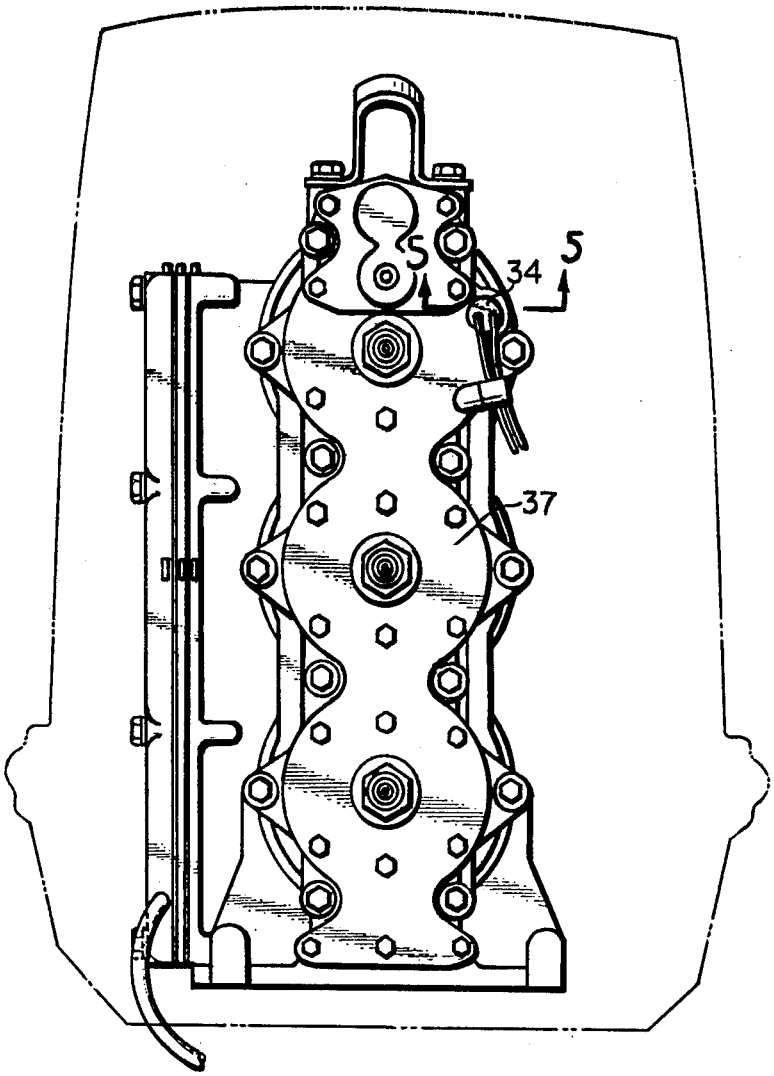
FIG. 4 is a side view of an engine incorporating the invention.
Figure 5:
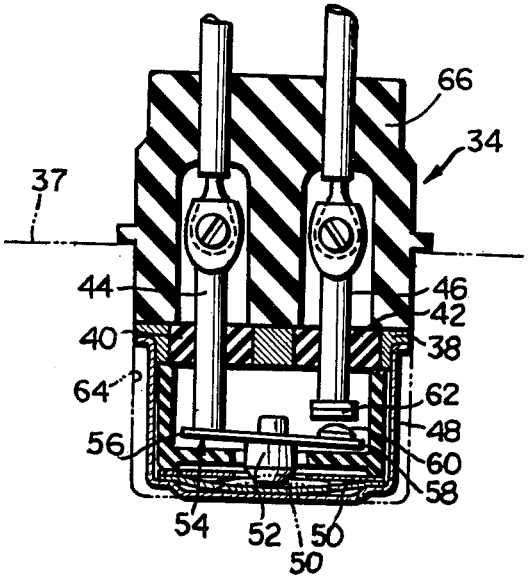
FIG. 5 is a section taken along line V—V in FIG. 4, and shows the construction of the thermo-switch.

Thermo-switch 34 is so constructed that it is closed when the engine is overheated, i.e., when the engine temperature exceeds a predetermined level. This thermo-switch will be described with reference to FIGS. 4 and 5. It is mounted, as shown in FIG. 4, in the cylinder head cover 37 of the outboard engine. As shown in FIG. 5, terminals 44 and 46 are attached through insulators 40 and 42 to a cover 38 which constitutes switch 34. Moreover, a case 48 is attached to the lower side of cover 38. On the bottom of the case 48, there is arranged a disc bimetal 50 which is made operative to take a shape which is warped downward at a temperature which is lower than a predetermined level. To the upper surface of the disc bimetal 50, there is attached a push rod 52 which is connected to a contact plate 54. Contact plate 54 has one of its ends 56 connected to the lower end portion of terminal 44. The other end 58 of contact plate 54 is formed with a movable contact 60. Terminal 46 has its lower end portion equipped with a stationary contact 62. Thermo-switch 34, thus constructed, is arranged in a hole 64 formed in the cylinder head cover 37, and has its top covered with an insulating cap 66.

The operations of thermo-switch 34 will be described as follows. In case the temperature around thermo-switch 34, i.e., the engine temperature, is equal to or lower than the predetermined level, the disc bimetal 50 takes the downwardly warped shape as indicated by solid lines in the Figure. At this temperature state, movable contact 60 and stationary contact 62 are parted from each other, so that terminals 44 and 46 of thermo-switch 34 are disconnected. The thermo-switch is open. Now, if the engine is overheated so that disc bimetal 50 becomes upwardly warped, as indicated at the double-dotted lines in the Figure, push rod 52 is lifted to connect movable contact 60 with stationary contact 62. Thus, if the engine is overheated, the thermo-switch 34 is closed.

The operations of the embodiment having the construction thus far described according to the present invention are as follows. First of all, if main switch 30 is turned on for starting the engine and choke switch 32 is closed, solenoid 16 is operated to close the choke valve 14. If choke switch 32 is opened after the engine starts, choke valve 14 is returned by a return mechanism (not shown) so that it is opened.

When the engine is overheated, as has been described hereinbefore, thermo-switch 34 is closed to actuate buzzer 36 and solenoid 16 with electric current. As a result, if the engine is overheated, buzzer 36 is sounded, and solenoid 16 is operated to close choke valve 14. When choke valve 14 is closed, the air-fuel mixture becomes over-rich to reduce the r.p.m. of the engine, whereby the engine temperature is reduced to prevent the engine from being overheated.

As has been described hereinbefore, the engine overheat preventing system according to the present invention is characterized in that the electromagnetic actuating means connected to the choke valve is connected with the electric power source through the choke switch and in that the thermo-switch is connected in parallel with said choke switch so that it is operated when the engine temperature exceeds the predetermined level to close said choke valve. As a result, the engine r.p.m. is reduced to lower the engine temperature so that the engine can be automatically prevented from being overheated.

This invention is not to be limited by the embodiment shown in the drawings and described in the description, which is given by way of example and not of limitation, but only in accordance with the scope of the appended claims.

I claim:

1. An engine overheat preventing system for an internal combustion engine having an electric power source, an intake passage with a throttle valve, and a choke valve, said system comprising: electromagnetic actuator means connected to said choke valve; a thermo-switch responsive to the temperature of said engine and connected to said electric power source and to said electromagnetic actuator means, said thermo-switch having an open and a closed condition, one of said conditions occurring above a reference temperature level, and the other below said level whereby said thermo-switch causes said electromagnetic actuator means to open said choke valve at temperatures below said reference level, and to close it at temperatures above said reference level, thereby to reduce the engine speed and allow its temperature to lower; and a manual open-closed choke switch connected in parallel with said thermo-switch, whereby said choke switch can cause said electromagnetic actuator means to close said choke valve, even at temperatures below said reference level.

2. A system according to claim 1 in which said choke switch is normally-open to permit said electromagnetic means to open said choke valve, and in which said thermo-switch is in its open condition at temperatures below said reference level.

* * * * *